United States Patent [19]

Fukuda

[11] 4,361,171

[45] Nov. 30, 1982

[54] WEAVING DEFECT DETECTOR

[76] Inventor: Tsutomu Fukuda, 785-1 Kunikane, Kamisocho, Kakogawashi, Japan

[21] Appl. No.: 142,376

[22] Filed: Apr. 21, 1980

[30] Foreign Application Priority Data

Jun. 27, 1979 [JP] Japan ..... 54-87017[U]
Jun. 27, 1979 [JP] Japan ..... 54-87018[U]
Jun. 27, 1979 [JP] Japan ..... 54-87019[U]
Jun. 27, 1979 [JP] Japan ..... 54-87020[U]

[51] Int. Cl.[3] ..... D03D 51/18

[52] U.S. Cl. ..... 139/348; 112/79 R; 66/166

[58] Field of Search ..... 139/348, 352; 26/7, 26/76; 112/79 R; 250/562, 563; 356/238, 431; 66/157, 166

[56] References Cited

U.S. PATENT DOCUMENTS 2,691,880 10/1954 Vossen ..... 66/166
2,859,603 11/1958 Edelman et al. ..... 66/166
2,976,706 3/1961 Reip ..... 66/166
3,276,227 10/1966 Althaus et al. ..... 139/348

*Primary Examiner*—Henry Jaudon
*Attorney, Agent, or Firm*—Oblon, Fisher, Spivak, McClelland & Maier

[57] ABSTRACT

A weaving detector for detecting weaving defects generated on the surface of a ground fabric of a carpet or rug moving in a first direction is disclosed. The weaving detector moves in the direction of the width of the cloth and includes one or more detecting sensors spaced in the direction of the movement of the cloth. A guide sled is connected to the sensors and has upwardly curved ends so as to prevent the catching of a defect by the sled. The sensors only provide a defect signal when both sensors simultaneously detect a defect. The sensors are supported by upper and lower supports having vibration absorbing springs therebetween so that the electrical controls are not damaged by the vibrations.

3 Claims, 6 Drawing Figures

WEAVING DEFECT DETECTOR

BACKGROUND OF THE INVENTION

1. Field of the Invention

This invention is concerned with a detection apparatus for weaving defects of a carpet or rug.

2. Description of the Prior Art

Many types of apparatuses to detect weaving defects of a carpet or rug have been proposed and actually been applied. However, they have many disadvantages such as that the detection sensor contacts with or is very close to the ground fabric and moves in the direction of the width of the ground fabric, causing the sensor to catch the weaving defect at the projected portion of the detection sensor. This has prevented the smooth moving of the detection sensor, or has enlarged the defect by the catching of it.

Further, the conventional detection apparatuses employ only one detection sensor to detect a weaving defect generated on the ground fabric, thereby detecting negligibly small weaving defects or yarn scrap, each time stopping the weaving machine and causing a reduction of working efficiency.

Further, the above stated conventional detection apparatuses have been very complicated to use because the detector, which moves on the surface of the ground fabric in the direction of its width to detect a weaving defect generated on the ground fabric, is fixed so as to make its bottom surface to be parallel with the surface of the ground fabric. Therefore, the sole of the detecting sensor is not parallel with the face of the ground fabric in cases where, for example, the spiked roller of the weaving machine is elevated and the ground fabric is moving upwardly inclined, or the case where inclination of ground fabric changes in accordance with weaving methods. Therefore it was necessary to use a different detecting sensor each time which was designed to make the sole lie parallel to the ground fabric in accordance with the installation of the ground fabric.

Also, because conventional detecting apparatuses were provided with no means to absorb vertical vibration of the detecting sensor, they had such disadvantages that vertical vibrations of the detection sensor could disturb the movement of the detecting sensor during its movement or cause failure in the electric system of the detecting sensor, or the detection accuracy could vary by the change of the distance between the bottom of the detecting sensor and ground fabric.

SUMMARY OF THE INVENTION

It is an object of the present invention to correct the above disadvantages of the conventional apparatus. Accordingly, the present invention includes a guide sled on the sole of the detecting sensor to detect weaving defects generated on the ground fabric moving in the direction of the width of the fabric of a carpet, rug, etc.. Located to the front and rear in the moving direction of the sensor, the sled has sloped surfaces upwardly inclined in the moving direction. The weaving defect detecting apparatus includes a sensor which does not pick up weave defects generated on the ground fabric surface during movement, moves smoothly, detects weaving defects exactly and does not enlarge the weaving defects by picking them up nor does it cause any defects on the ground fabric surface.

A further object of the present invention is to provide two detecting sensors arranged to be separated by a certain distance in the direction of the movement of the ground fabric and to move together. They issue a detection signal only when the above two detectors simultaneously detect a weaving defect. Therefore, the weaving defect detecting apparatus does not stop the weaving machine because of a negligible weaving defect or merely a yarn scrap, but only stops by detecting a weaving defect requiring repair. This improves the working efficiency by eliminating unnecessary stopping of the weaving machine.

A further object of the present invention is to support the detecting sensor by an angle adjusting bolt installed parallel to the moving direction so that the sole may incline to the direction perpendicular to the movement of the detecting sensor, for the purpose of offering a weaving defect detecting apparatus which can easily adjust the sole of the detecting sensor to be parallel with the inclination of the surface of the ground fabric when the angle may be changed by a weaving machine or weaving method.

A further object of the present invention is to connect the lower support which is supporting the detecting sensor and the upper support which is moving in a guide duct with a hanging bolt arranged to absorb vertical vibrations acting on the lower support. To this end, coil springs are inserted in bolt holes formed in the center portion of the upper support for the purpose of offering a weaving defect detecting apparatus by which the detecting sensor does not catch a weaving defect on the ground fabric during moving, and moves smoothly and absorbs vertical vibrations acting on the detecting sensor during moving to prevent failure of electric systems and to keep the gap between the bottom of the detecting sensor and the surface of the ground fabric always constant for maintaining detecting accuracy constant.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
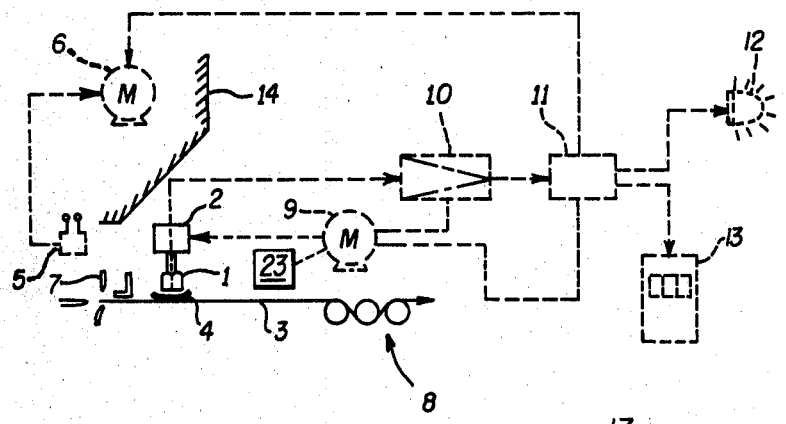
FIG. 1 is a control circuit diagram of the weaving defect detecting apparatus of the present invention.

Referring to the Figures, numeral 1 designates a weaving defect detecting sensor hanging from a guide duct 2 and arranged to move on the ground fabric 3 of a carpet or rug in the direction of the width of the fabric along the guide duct 2. Numeral 4 designates a guide sled attached to the bottom of the detecting sensor 1.

Numeral 5 designates a starting button, arranged to be pushed for the starting of the weaving machine driving motor 6, which is devised to operate the weaving machine. The ground fabric 3 woven by needle 7 is to be rolled up by spiked rollers 8.

Numeral 9 is a scanning motor, which acts as the power source to move the detecting sensor 1 along the guide duct 2.

When the detecting sensor 1, which may be a visual detector, for example, detects a weaving defect while moving on a surface of the ground fabric 3, the detected signal is intensified by an intensifier 10 which immediately turns off the switch of the scanning motor 9 to stop the movement of the detecting sensor 1. The intensified signal is then fed to a relay circuit 11 to turn off the switch of the weaving machine driving motor 6 and stop the operation of the weaving machine and at the same time inform the operator of the generation of a weaving defect by flickering an alarm lamp 12 as well as inputted to a counter 13 to indicate the counting of the weaving defect.

When a weaving defect is detected by the above control circuit and the operation of the weaving machine is stopped, and after the weaving defect is repaired, a push of the starting button 5 will reset the switches of the weaving machine driving motor 6 and the scanning motor 9 which leads to the operation of the weaving machine and the movement of the detection sensor 1.

Figure 2:
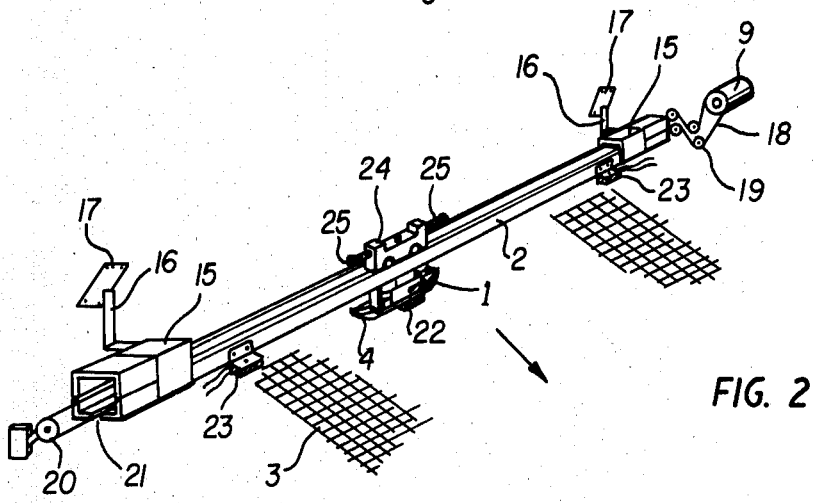
FIG. 2 is a general perspective view.

FIG. 2 is a general assembled perspective view of a weaving defect detection apparatus related to the present invention, in which the guide duct 2 has sufficient length in the direction of the width of the ground fabric 3 so that it projects beyond the edges of the ground fabric and is securely fixed to the side walls 14 of the main body of the weaving machine shown in FIG. 1 through supporting arm 16 and attaching plates 17 which are attached to supporting covers 15 connected to the both ends of the guide duct 2.

As seen in FIG. 2, wire 18 which is endlessly driven by the scanning motor 9, is extensionally supported by guide pulleys 19 and an end pulley 20, and the portions of the wire 18 between the guide pulley 19 and the end pulley 20 are arranged to run almost mutually parallel along a necessary distance within the guide duct 2.

The detecting sensor 1 is hung by its upper part from the guide duct 2, and is arranged to be held by either of the wires 18 running in the guide duct 2. The sensor moves along a guide groove 21 fixed to the base of the guide duct 2.

A location detecting plate 22 is attached near the side of the detecting sensor 1, and when the detecting sensor 1 is moved and has arrived at the edge of the ground fabric 3, the location detecting plate 22 will coincide with the under side of a location detector 23 attached to the end side of the guide duct 2 and issue a coincidence signal. This coincidence signal causes the scanning motor 9 to reverse rotating and causes the detecting sensor 1 to go backwards. Therefore, by fixing the location detectors 23 to both ends of the guide duct 2, the detecting sensor 1 will reciprocate in the guide duct 2 while hanging from it, by the automatic change over of the scanning motor 9 to the forward and backward directions.

Because of the time lag involved in the switching over of the scanning motor 9 from one direction to another, the detection sensor 1 has a tendency to overrun an edge of the ground fabric 3 by its inertial force. Therefore, cushioning projections 25 are fixed to the front and rear faces of the upper support 24 so that when detection sensor 1 overruns either side of the guide duct 2, a cushioning projection 25 will hit the end face of the supporting cover 15 and the sensor will stop by absorbing the resulting shock. Therefore, if the location detector 23 fails and the scanning motor 9 fails to automatically change over, the shock of the detecting sensor 1 hitting the supporting cover 15 will be sufficiently absorbed by the cushioning projection 25, and the failure of detecting sensor 1 by the shock of hitting can be advantageously avoided.

Figure 3:
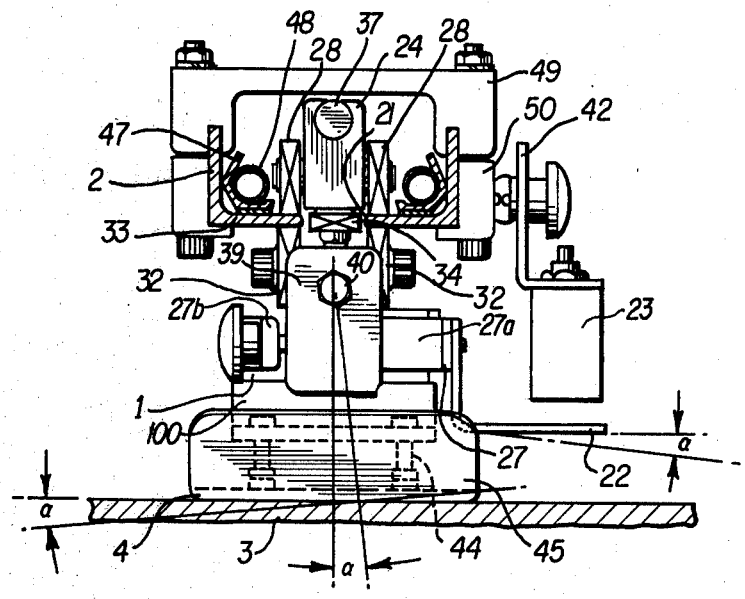
FIG. 3 is a elevational sectional view indicating the hanging status of the detection apparatus.
Figure 4:
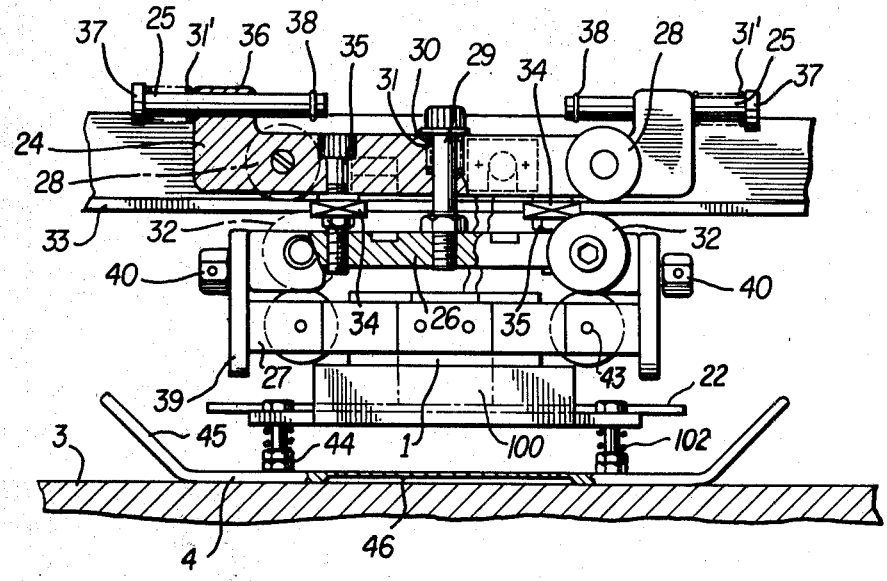
FIG. 4 is a side sectional view of the sensor.

A further detailed explanation of the structure of the weaving defect detecting apparatus of this invention will be made in reference to FIGS. 3–5 inclusive.

As seen in the Figures, detecting sensor 1 is clamped to a lower support 26 having a sensor holder 27. To the upper support 24, two paired guide rollers 28 are hinged to the front and rear of both sides to rotate freely. The upper support 24 and lower support 26 are mutually connected at their center with hanging bolt 29. The hanging bolts 29 is inserted through a coil spring 31 which is positioned in a bolt hole 30 formed in the center part of the upper support 24 so that the elastic force of the coil spring 31 will absorb vertical direction vibrations acting on the lower support 26.

Therefore, when the detection sensor 1 moves over the surface of the ground fabric 3, the coil spring 31 acts to press the guide sled 4 to the face of the ground fabric 3 when there is some degree of uneveness on the upper face of the ground fabric 3, and vertical vibrations are effectively absorbed by the coil spring 31, allowing the detecting sensor 1 to always steadly detect the weaving defects on the surface of the ground fabric 3. The sensor 1 moves smoothly without causing any vibration or noise and the movement is efficient and steady without fear of causing failure of any parts including the electric system.

Guide rollers 32 are fixed to the lower support 26 at a place corresponding to the guide rollers 28 in the upper support body 24. The guide rollers 28 and 32 rotate with the base rail 33 of the guide duct 2 inserted therebetween. Horizontal guide rollers 34 are attached to the upper support via bolts 35 with hanging bolt 29 placed therebetween. The horizontal guide rollers 34 are located at the base of the guide duct 2, and in the guide groove 21 formed between base rails 33. The rollers 34 are so arranged that their external surfaces will be guided by both sides of the guide groove 21 so that they rotate and guide the detecting sensor 1 to always advance linearly, thereby preventing side sway whenever the detecting sensor is moved.

The cushioning projections 25 are installed through holes 36, formed in the front and rear faces of the upper support 24. The projections 25 have contact heads 37 at one of their ends, and stoppers 38 at the rear ends to prevent the falling off of the projections. Coil springs 31' are installed between the contact heads 37 and the front and rear end faces of the upper support 24, and when a contact head 37 contacts the end face of the supporting cover 15, the cushioning projection 25 presses coil spring 31' as it moves in the hole 36. When contact is released, the cushioning projection will be restored to the original position by the coil spring 31'.

Although the detecting sensor 1 is supported by clamping with the sensor holder 27, holder adapters 39, which extend upwards from the end side face of the sensor holder 27, are formed with angle adjusting bolts 40 extending parallel with the moving direction of detecting sensor 1. The detecting sensor 1, which is clamp supported by sensor holder 27, is supported to the front and rear face of the lower support 26 by angle adjusting bolts 40 via sensor holder 27 and adaptors 39.

The detecting sensor 1 which is clamp supported by the sensor holder 27 can be inclined for an arbitrary angle $\alpha$ by loosening the angle adjusting bolts 40. Therefore, the sole of the guide sled 4 can be set with an angle $\alpha$ perpendicular to the moving direction of the detecting sensor 1 by tightening the angle adjusting bolts 40 in an inclined condition.

Such an arrangement to allow the detecting sensor 1 to be set in an inclined position gives an advantageous application in, for example, a type of weaving machine in which the spiked roller 8 is located at a higher position than that indicated in FIG. 1 and the ground fabric 3 is moving while upwardly inclined. The detecting sensor 1 can be inclined in accordance with the slope angle of the ground fabric 3, and the apparatus can be adapted to any type of weaving machine without relation to the inclination of the ground fabric 3, by simply adjusting the angle adjusting bolts 40.

Figure 5:
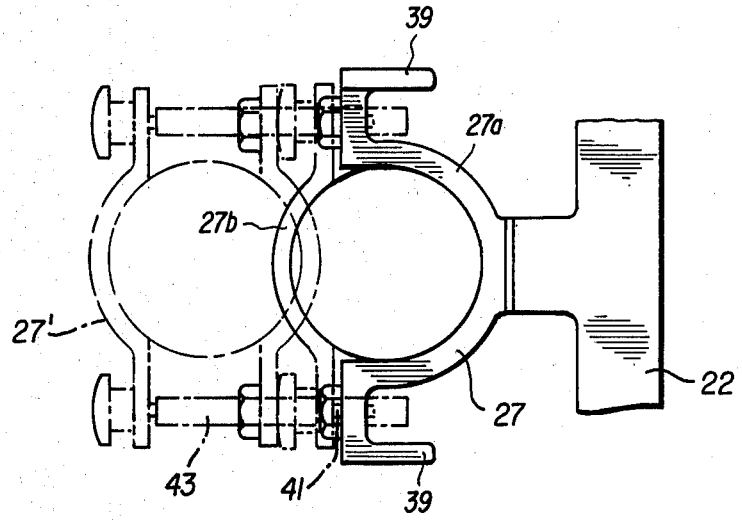
FIG. 5 is a plan view of the sensor holder.

FIG. 5 is a plan view of the sensor holder 27, it may be seen from the Figure that the sensor holder is formed in two parts 27*a* and 27*b*, thereby forming a space for securely clamping the detecting sensor 1 between both halves. The split body halves are made to be screw tightened at both ends independently by bolts 41.

The location detecting plate 22, is shown in the drawing as horizontally projected from the periphery of one side of a split half of the sensor holder. It does not come parallel with the base of the location detector 23 which is attached to the side of the guide duct 2 by a fixture piece 42, causing the danger that location detector 23 may not operate accurately. It is therefore necessary to set the location detecting plate 22 downwards in accordance with the inclination of detection sensor 1 as shown in the Figure so that location detecting plate 22 and the sole of the location detector 23 become parallel.

Figure 6:
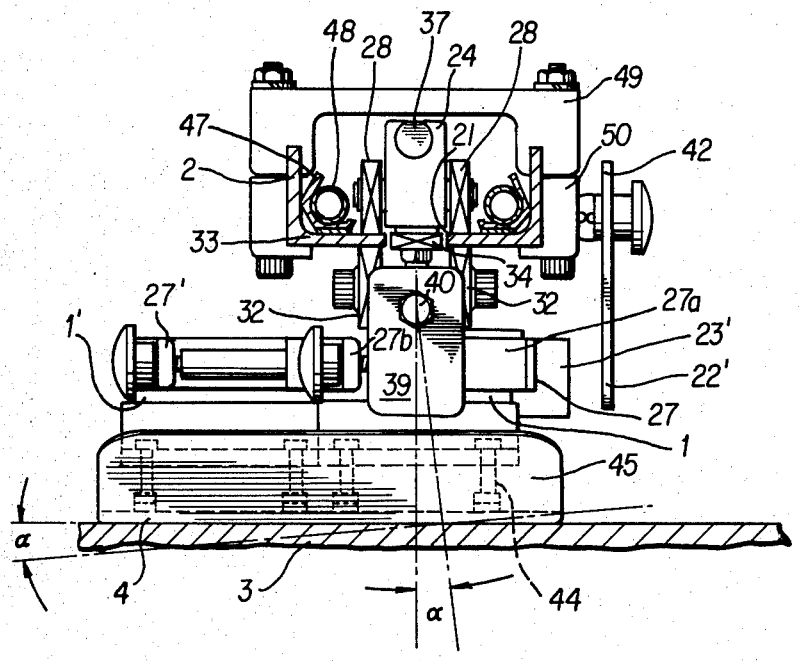
FIG. 6 is an elevational view similar to FIG. 3 but showing a detector sensor.

Although, in this exemplary embodiment the location detecting plate 22 is attached to the sensor holder 27 and the location detector 23 to the side face of the guide duct 2, it is obvious that the location detector 23' may be attached to the sensor holder 27, and the location detecting plate 22' to the side of the guide duct 2 as seen in FIG. 6.

As shown in FIG. 5, by arranging two sensor holders 27, 27' with a certain predetermined small distance therebetween and locating through bolt 43 through the ends of both holders and by tightening the lock nuts and screws to tighten and support the detecting sensors 1 and 1' to sensor holder 27 and 27' respectively, then the detecting sensors 1 and 1' can be fixed at a certain spacing in the moving direction of the ground fabric 3. Therefore, movement of the detecting sensor 1, which is hangingly supported by the guide duct 2, makes the other detecting sensor 1', which is supported by the sensor holder 27', move simultaneously. The two sensors can parallely and simultaneously detect a weaving defect on the ground fabric 3, with the two detecting sensors 1 and 1' arranged at a certain distance in the moving direction of the ground fabric 3. Therefore, by contrast with a conventional arrangement having only one detecting sensor 1, frequent stops of the weaving machine occur each time even a scrap yarn or negligible small weaving defect other than the countable weaving defects is detected resulting in low working efficiency. By installing two spaced detecting sensors as shown in this exemplary embodiment, and devising them so that a weaving defect signal will be transmitted to the amplifier 10 only when both detecting sensors 1 and 1' simultaneously detect a defect, detection of a small defect or yarn scrap by one detection sensor only will not transfer a weaving defect detecting signal to the amplifier 10, and the weaving machine will not make unnecessary stops. The two detecting sensors 1 and 1' can detect only those weave defects actually requiring repair which is advantageous and improves working efficiency.

Although in this exemplary embodiment, the guide sled 4 is attached to the sole of the detecting sensor 1 via intermediate member 102 with support bolts 44 providing a certain distance therebetween, a modification of installing a coil spring 102 around each of the support bolt so that the distance can be changed against the compression force of the springs offers very advantageous results as the vertical vibration of the guide sled 4 is absorbed more effectively. To the front and rear of the guide sled 4 are formed gradually upward inclining sloped surfaces 45 to prevent the sled from catching or picking up a weaving defect. Detecting hole 46 is formed in the center portion of the guide sled 4 corresponding to the sole of the detecting sensor 1, and detecting sensor 1 detects weaving defects through hole 46.

It is clear that the guide sled 4 must be attached to each detecting sensor 1 and 1' when two detecting sensors are used.

Numeral 47 designates guide elements for the guide wires 18 installed in parallel along the corners of the guide duct 2, and the wires 18 are accommodated through the openings of the guide elements 47, and are arranged to be driven. Numeral 48 designates a fixing piece which fixes above wire 18 and the sides of upper support 24, and is installed in conjunction with the opening of the guide element 47 so that the movement of wire 18 will not be affected.

In this exemplary embodiment the end of the guide duct 2 is supported by inserting it between the upper cover 49 and the lower cover 50 which is fixed to the upper cover by bolts. It is clear that separable construction of upper cover 49 and lower cover 50 allows very easy installation of disassembly of the guide duct 2 and is advantageous for the repairing or replacement of parts.

As is explained in detail above, in the described embodiment of the present invention, a guide sled having sloped surfaces at the front and rear of the detecting sensor and inclined gradually upwards to the direction of the movement of the sensor, is installed to the bottom surface of detecting sensor which moves on a ground fabric of carpet or rug in its width direction and detects the weaving defects that arose on the surface of the ground fabric. Therefore, it has many advantages such as:

(1) The detecting sensor does not damage the surface of the ground fabric, and moves smoothly, because the detecting sensor moves on the surface of the ground fabric, guided with a guide sled.

(2) Because of gradually upwards inclined surface along the moving direction of the sensor at the front and rear of the guide sled, weaving defects on the face of the ground fabric do not tend to be caught, therefore the present invention is free from the tendency of the conventional detecting sensor to pick up small weaving defects and enlarge them.

(3) In spite of some uneveness on the ground fabric, the detecting sensor does not catch places other than weaving defects, causing it to stop itself, because the detecting sensor is guided by the guide sled.

(4) Because of its smooth movement, the detecting sensor does not cause unnecessary vibration, therefore the electric system, which is especially vulnerable, will not be affected, and can be used reliably for a longer period.

(5) Because the detecting sensor does not pick up and stop at places other than weaving defects, the weaving machine does not stop unnecessarily, resulting in higher working efficiency.

As has been explained in detail, the present invention uses two detecting sensors which detect weaving defects generated on the ground fabric of carpet or rug by moving in the direction of the width of the ground fabric. Two detecting sensors are arranged at a certain distance in the direction of the movement of the ground fabric and move together. The sensors issue a detecting signal only when the above two detecting sensors simultaneously detect a weaving defect. The present invention therefore further has the following advantages:

(1) A negligible small weaving defect or mere yarn scrap on the ground fabric does not cause the issuance of a detection signal of a weaving defect, because only one of the detection sensors detects it. Therefore, this eliminates unnecessary stopping of the weaving machine, resulting in the improvement of working efficiency.

(2) Only those weaving defect which require repair can be detected by the two detecting sensors arranged at a predetermined distance in the direction of the movement of the ground fabric.

(3) Detecting accuracy of the weaving defect can be changed by changing the distance of the two detecting sensors.

(4) Two detecting sensors being used are identical to each other, resulting in simple structure and low cost.

As explained above in detail, the present invention also offers an apparatus which includes an angle adjusting bolt arranged parallel to the moving direction so that the sole can be inclined to the direction perpendicular to the movement of the detecting sensor. This feature has many advantages as the following:

(1) It can be used for different inclinations of the ground fabric according to the types of the weaving machine.

(2) It can follow the changing of the inclination of the ground fabric according to the weaving pattern.

(3) The inclination angle of the sole of the detection sensor can easily be adjusted only by loosening the angle adjusting bolt, and fine adjustment is allowed each time, and the detection accuracy can be stabilized.

(4) The structure is simple and can be built at a low cost, and the operation is easy, to permit operation even by unskilled personnel.

As has been explained in detail, this invention also provides a guide sled in which the lower support which supports the detecting sensor and the upper support which moves in a guide duct are provided with a hanging bolt so that coil springs inserted in bolt holes formed in the center portion of the upper support may absorb vertical vibrations. This feature has many advantages such as the following:

(1) Because the vertical vibrations acting on the moving sensor are effectively absorbed by the coil springs, the electric system of the detecting sensor will not fail and endures a long period of use.

(2) In spite of some uneveness formed on the surface of the ground fabric, the detecting sensor is pressed by the coil springs. The guide sled is fixed to the bottom of the detecting sensor and always moves pressed to the ground fabric surface, and the gap between the bottom surface of detecting sensor and the surface of the ground fabric is kept always constant, resulting in the detecting accuracy being kept always constant and stable.

(3) The pressing force between the guide sled and ground fabric face can be adjusted freely by changing the coil springs or adjusting the screw tightening force of the hanging bolt.

(4) The construction is relatively simple and can be built at low cost, and the operation is easy and does not cause noise.

Therefore the present invention is far more effective in comparison with conventional apparatus, and the structure is simple, can be made at a low cost, and provides a practical and advantageous weaving defect detecting apparatus.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A weaving detector for detecting weaving defects generated on the surface of a ground fabric of a carpet or rug moving a first direction, comprising:

at least one detector sensor;

means for moving said each at least one detector sensor in a second direction perpendicular to said first direction; and a guide sled connected to all of said at least one said detector sensors and adapted to be positioned adjacent the surface of said ground fabric for maintaining said at least one sensor at a fixed distance from said fabric, said guide sled including upwardly inclined portions at each end in said second direction, whereby said upwardly inclined portions prevent defects from being caught by said guide sled, wherein there are at least two detector sensors spaced from one another in said first direction, wherein said at least two sensors move together and wherein said at least two sensors are adapted to issue a signal only when all of said sensors simultaneously detect a defect.

2. A weaving detector for detecting weaving defects generated on the surface of a ground fabric of a carpet or rug moving in a first direction, comprising:

at least one detector sensor;

means for moving said each at least one detector sensor in a second direction perpendicular to said first direction; and a guide sled connected to all of said at least one said detector sensors and adapted to be positioned adjacent the surface of said ground fabric for maintaining said at least one sensor at a fixed distance from said fabric, said guide sled including upwardly inclined portions at each end in said second direction, whereby said upwardly inclined portions prevent defects from being caught by said guide sled, including means for selectively pivoting all of said at least one detector sensors about an axis parallel to said second direction, said means for selectively pivoting comprising selectively actuatable locking bolts, whereby the bottoms of all of said at least one sensors may be inclined about an axis perpendicular to said first direction.

3. A weaving detector for detecting weaving defects generated on the surface of a ground fabric of a carpet or rug moving in a first direction, comprising:

at least one detector sensor;

means for moving said each at least one detector sensor in a second direction perpendicular to said first direction; and a guide sled connected to all of said at least one said detector sensors and adapted to be positioned adjacent the surface of said ground fabric for maintaining said at least one sensors at a fixed distance from said fabric, said guide sled including upwardly inclined portions at each end in said second direction, whereby said upwardly inclined portions prevent defects from being caught by said guide sled, wherein said means for moving comprises an upper support, a lower support to which said at least one sensor is fixed, a hanging bolt for connecting said upper and lower supports for vertical movement therebetween, and a spring means associated with said hanging bolt for biasing said lower support relative to said upper support, whereby vertical vibrations are absorbed by said spring means.

* * * * *